US011749449B2

(12) United States Patent
Sasaki et al.

(10) Patent No.: US 11,749,449 B2
(45) Date of Patent: Sep. 5, 2023

(54) INDUCTOR COMPONENT

(71) Applicant: Murata Manufacturing Co., Ltd., Kyoto-fu (JP)

(72) Inventors: Tatsuya Sasaki, Nagaokakyo (JP); Shinya Hirai, Nagaokakyo (JP); Shin Hasegawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 371 days.

(21) Appl. No.: 17/025,796

(22) Filed: Sep. 18, 2020

(65) Prior Publication Data

US 2021/0090787 A1 Mar. 25, 2021

(30) Foreign Application Priority Data

Sep. 19, 2019 (JP) ..... 2019-170640

(51) Int. Cl.
*H01F 27/29* (2006.01)
*H01F 17/04* (2006.01)

(52) U.S. Cl.
CPC ..... *H01F 27/292* (2013.01); *H01F 17/045* (2013.01)

(58) Field of Classification Search
CPC ..... H01F 27/292; H01F 17/045
See application file for complete search history.

(56) References Cited

U.S. PATENT DOCUMENTS

2013/0154780 A1* 6/2013 Yamada ..... H01F 27/29 336/175
2016/0181007 A1* 6/2016 Shiokawa ..... H01F 41/08 29/606
2016/0314895 A1* 10/2016 Shiokawa ..... H01F 17/062
(Continued)

FOREIGN PATENT DOCUMENTS

CN 106257603 A 12/2016
CN 107533898 A 1/2018
(Continued)

OTHER PUBLICATIONS

An Office Action mailed by China National Intellectual Property Administration dated Mar. 8, 2022, which corresponds to Chinese Patent Application No. 202010985496.8 and is related to U.S. Appl. No. 17/025,796 with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

An inductor component includes a bottom plate portion that includes a first main surface and a second main surface; an annular core that is disposed on the bottom plate portion; a coil that is wound around the core; and an electrode terminal that is attached to the bottom plate portion and electrically connected to the coil. The electrode terminal includes a mounting surface portion configured to connect to a mount substrate. The core is disposed on the first main surface of the bottom plate portion so that an axis of the core intersects
(Continued)

the first main surface of the bottom plate portion. The mounting surface portion is exposed on the second main surface side of the bottom plate portion, and at least a part of the mounting surface portion overlaps the core when seen in a direction perpendicular to the first main surface of the bottom plate portion.

20 Claims, 13 Drawing Sheets

(56) References Cited

U.S. PATENT DOCUMENTS

| | | | | |
|---|---|---|---|---|
| 2016/0372261 | A1 | 12/2016 | Ozawa | |
| 2018/0025831 | A1* | 1/2018 | Sasaki | H01F 27/29<br>336/221 |
| 2018/0308625 | A1* | 10/2018 | Hasegawa | H01F 27/2823 |
| 2020/0203052 | A1* | 6/2020 | Murakami | H01F 27/2828 |

FOREIGN PATENT DOCUMENTS

| | | | | | |
|---|---|---|---|---|---|
| JP | 2000182838 | A | * | 6/2000 | |
| JP | 2000182838 | A | | 6/2000 | |
| JP | 2016-187031 | A | | 10/2016 | |
| WO | WO-2017141838 | A1 | * | 8/2017 | H01F 17/045 |
| WO | 2017169737 | A1 | | 10/2017 | |

* cited by examiner

INDUCTOR COMPONENT

CROSS-REFERENCE TO RELATED APPLICATION

This application claims benefit of priority to Japanese Patent Application No. 2019-170640, filed Sep. 19, 2019, the entire content of which is incorporated herein by reference.

BACKGROUND

Technical Field

The present disclosure relates to an inductor component.

Background Art

Japanese Unexamined Patent Application Publication No. 2000-182838 describes an example of an inductor component according to the related art. The inductor component includes a lower case, a bar-shaped core disposed in the lower case, and an electrode terminal attached to the lower case and electrically connected to the coil.

In the inductor component according to the related art, the electrode terminal is disposed at a position that are displaced outward from the core when seen in a direction perpendicular to a bottom surface of the lower case. Therefore, an additional space for disposing the electrode terminal is necessary, and the inductor component has a problem in that the inductor component has a large size in a direction along the bottom surface of the lower case.

SUMMARY

The present disclosure provides an inductor component that can be reduced in size.

An inductor component according to an aspect of the present disclosure includes a bottom plate portion that includes a first main surface and a second main surface that face each other; an annular core that is disposed on the bottom plate portion; a coil that is wound around the core; and an electrode terminal that is attached to the bottom plate portion and electrically connected to the coil. The electrode terminal includes a mounting surface portion that is to be connected to a mount substrate. The core is disposed on the first main surface of the bottom plate portion so that an axis of the core intersects the first main surface of the bottom plate portion. The mounting surface portion is exposed on the second main surface side of the bottom plate portion, and at least a part of the mounting surface portion overlaps the core when seen in a direction perpendicular to the first main surface of the bottom plate portion.

With the aspect, because at least a part of the mounting surface portion overlaps the core when seen in a direction perpendicular to the first main surface of the bottom plate portion, the size of the inductor component in a direction along the first main surface of the bottom plate portion can be reduced, and the inductor component can be reduced in size.

Preferably, in an inductor component according to an embodiment, the electrode terminal includes a connection surface portion that is connected to the mounting surface portion and connected to the coil, and a fillet surface portion that is connected to the mounting surface portion and along which solder is to creep up; and the connection surface portion and the fillet surface portion are each disposed further outward, in a direction along the first main surface of the bottom plate portion, than the mounting surface portion that is exposed on the second main surface side.

With the embodiment, because the connection surface portion and the fillet surface portion are disposed further outward with respect to the bottom plate portion than the mounting surface portion, the connection surface portion and the fillet surface portion need not be disposed on the bottom surface of the inductor component, and the inductor component can be further reduced in size.

Preferably, in an inductor component according to an embodiment, wherein the bottom plate portion is substantially rectangular when seen in the direction perpendicular to the first main surface of the bottom plate portion, and the electrode terminal is disposed at a corner of the substantially rectangular bottom plate portion.

With the embodiment, the electrode terminal can be disposed in a vacant space on the bottom plate portion that is generated when the core and the coil are placed on the bottom plate portion, and the inductor component can be further reduced in size.

Preferably, in an inductor component according to an embodiment, the bottom plate portion includes two first side surfaces that extend in a first direction and face in a second direction perpendicular to the first direction when seen in the direction perpendicular to the first main surface of the bottom plate portion, and two second side surfaces that extend in the second direction and face in the first direction. Also, the connection surface portion is disposed on a corresponding one of the first side surfaces of the bottom plate portion, and the fillet surface portion is disposed on a corresponding one of the second side surfaces of the bottom plate portion.

With the embodiment, the connection surface portion and the fillet surface portion need not be disposed on the bottom surface of the inductor component, and the inductor component can be further reduced in size.

Preferably, in an inductor component according to an embodiment, the first side surfaces each have a first recessed groove at a corner of the bottom plate portion, and the second side surfaces each have a second recessed groove at a corner of the bottom plate portion. Also, the connection surface portion is inserted into the first recessed groove, and the fillet surface portion is inserted into the second recessed groove.

With the embodiment, the connection surface portion and the fillet surface portion can be disposed at a position that is not on the bottom surface of the inductor component and that is further inward than the outer periphery of the bottom plate portion, and the inductor component can be further reduced in size.

Preferably, in an inductor component according to an embodiment, the connection surface portion is perpendicular to the mounting surface portion.

With the embodiment, because the connection surface portion is perpendicular to the mounting surface portion, a sufficient distance can be maintained in the electrode terminal via the mounting surface portion, and therefore influence of heat generated in the connection surface portion is not easily transferred to the mounting surface portion. Moreover, because the connection surface portion is perpendicular to the mounting surface portion, the space occupied by the electrode terminal can be reduced in a direction parallel to the first main surface of the bottom plate portion.

Preferably, in an inductor component according to an embodiment, an outer peripheral surface of the core extends in the direction perpendicular to the first main surface of the bottom plate portion, and a pin member of the coil is directed in the direction perpendicular to the first main surface of the bottom plate portion. Also, the connection surface portion is parallel to the outer peripheral surface of the coil when seen in the direction perpendicular to the first main surface of the bottom plate portion.

With the embodiment, because the connection surface portion does not protrude from the outer peripheral surface of the coil, and therefore the inductor component can be further reduced in size. Moreover, because the connection surface portion can be disposed parallel to the outer peripheral surface of the coil, the length of an electrical path to the coil can be reduced, and direct-current resistance can be reduced.

Preferably, in an inductor component according to an embodiment, the bottom plate portion exists between the mounting surface portion and the core in the direction perpendicular to the first main surface of the bottom plate portion.

With the embodiment, because the bottom plate portion exists between the mounting surface portion and the core, the coil wound around the core can be prevented from making contact with the mounting surface portion and becoming electrically connected to the mounting surface portion.

Preferably, an inductor component according to an embodiment further includes a box portion that covers the coil, and the connection surface portion is inserted into the box portion.

With the embodiment, because the connection surface portion is inserted into the box portion, the connection surface portion is not easily interfered with from the outside, and the reliability of connection between the connection surface portion and the coil can be increased.

Preferably, in an inductor component according to an embodiment, the fillet surface portion is exposed to an outside of the box portion, a protruding portion is formed on an outer surface of the box portion on which the fillet surface portion is positioned, and the protruding portion is positioned further outward than the fillet surface portion in a direction perpendicular to the outer surface.

With the embodiment, because the fillet surface portion faces the surface of the box portion on which the protruding portion is formed, another member can be prevented from abutting against the protruding portion and coming into contact with the fillet surface portion.

With the inductor component according the aspect of the present disclosure, reduction in size can be achieved.

Other features, elements, characteristics and advantages of the present disclosure will become more apparent from the following detailed description of preferred embodiments of the present disclosure with reference to the attached drawings.

DETAILED DESCRIPTION

Figure 1:
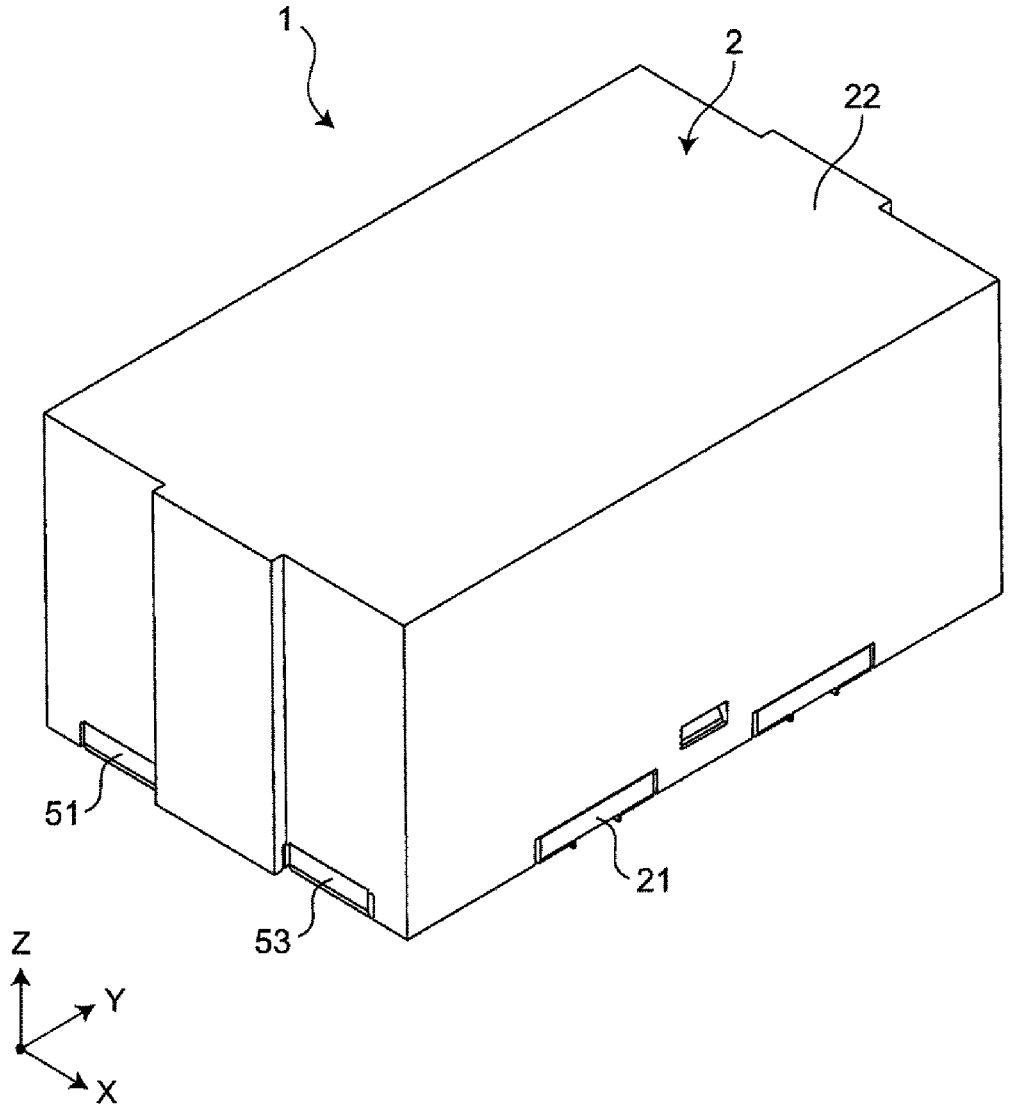
FIG. 1 is an upper perspective view of an inductor component according to an embodiment of the present disclosure.

Hereafter, inductor components according to embodiments of the present disclosure will be described in detail with reference to the drawings. The drawings include schematic views, and dimensions and proportions in the drawings may differ from actual ones.

Embodiment

Configuration of Inductor Component

Figure 2:
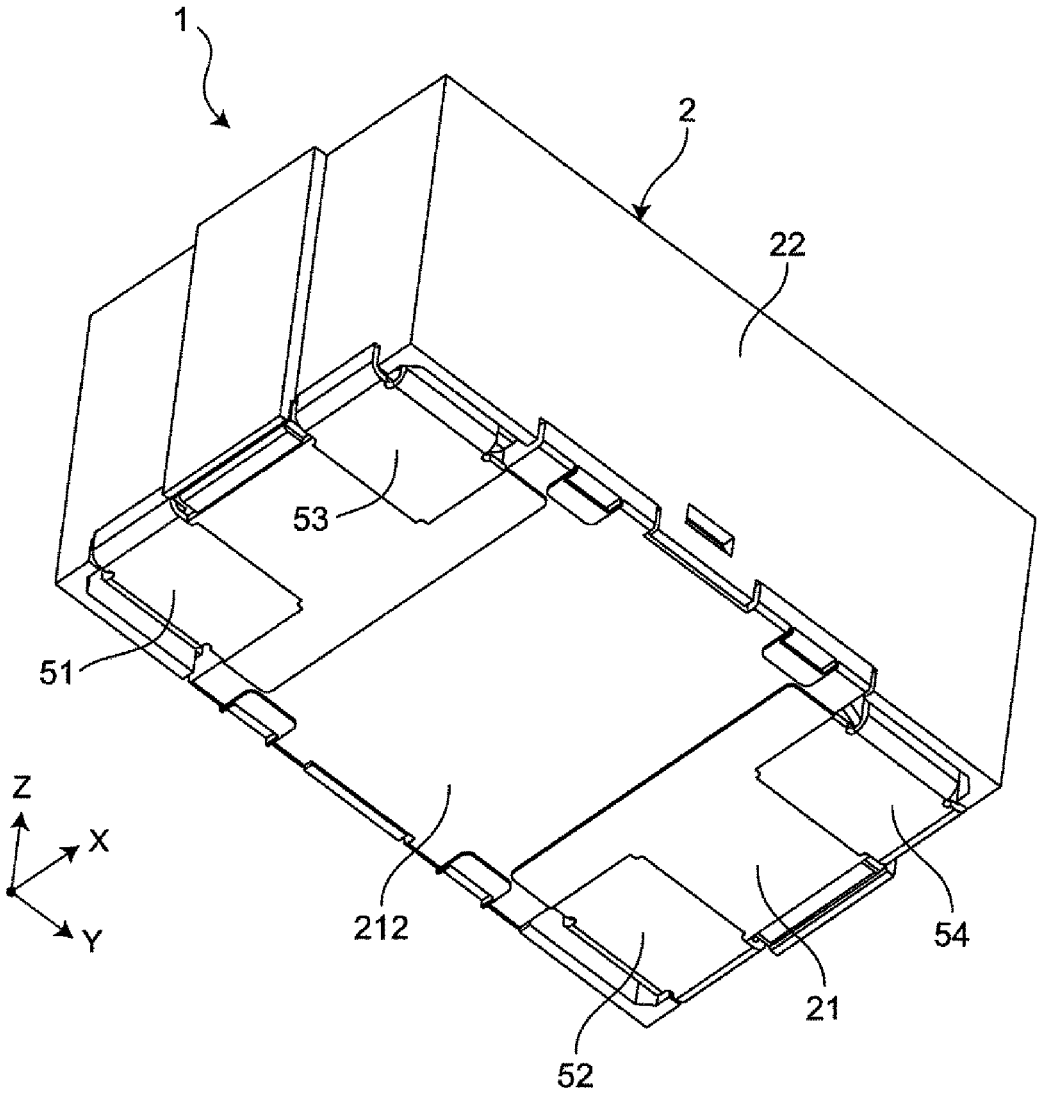
FIG. 2 is a lower perspective view of the inductor component according to the embodiment of the present disclosure.
Figure 3:
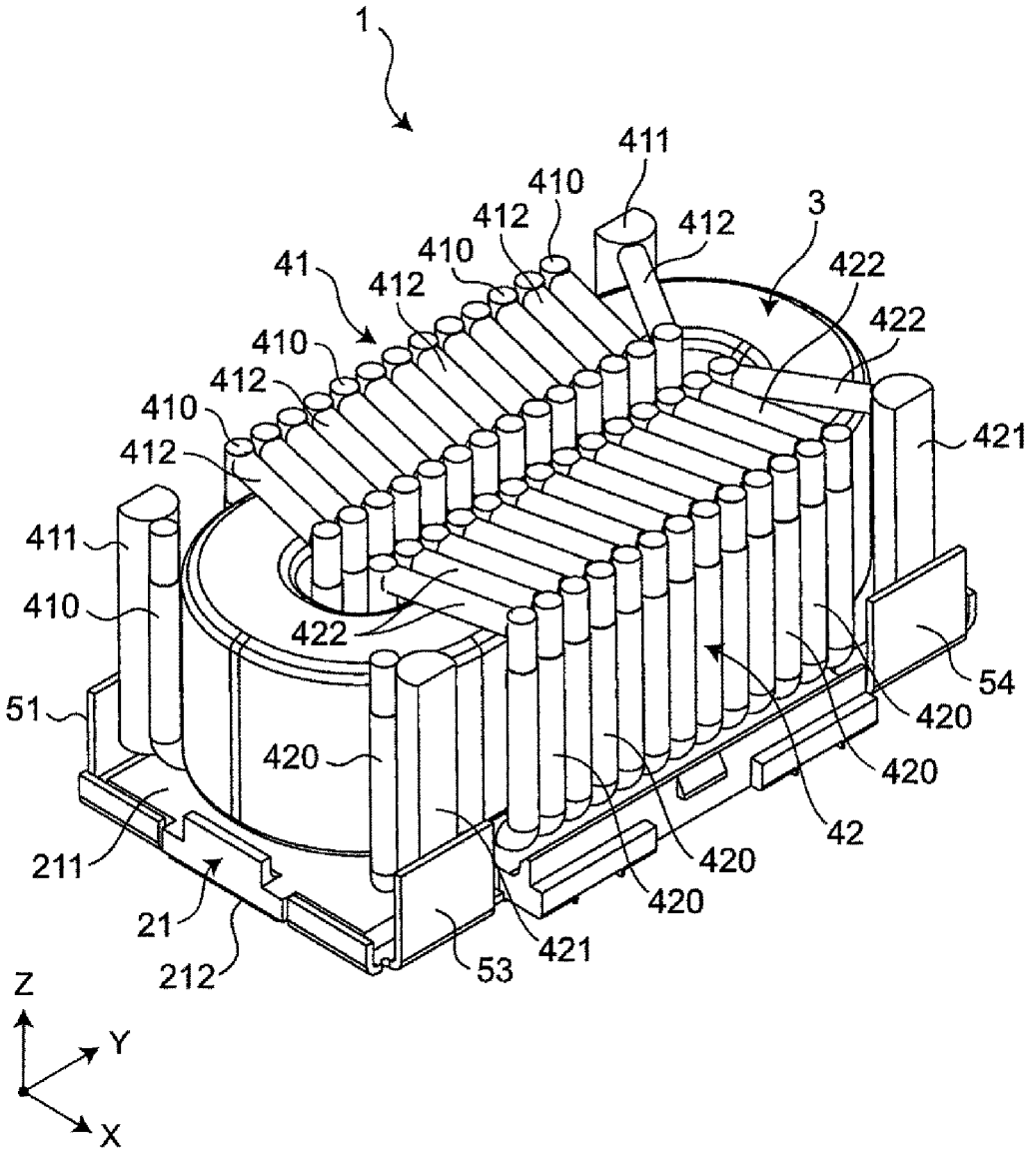
FIG. 3 is an upper perspective view illustrating the inside of the inductor component according to the embodiment of the present disclosure.
Figure 4:
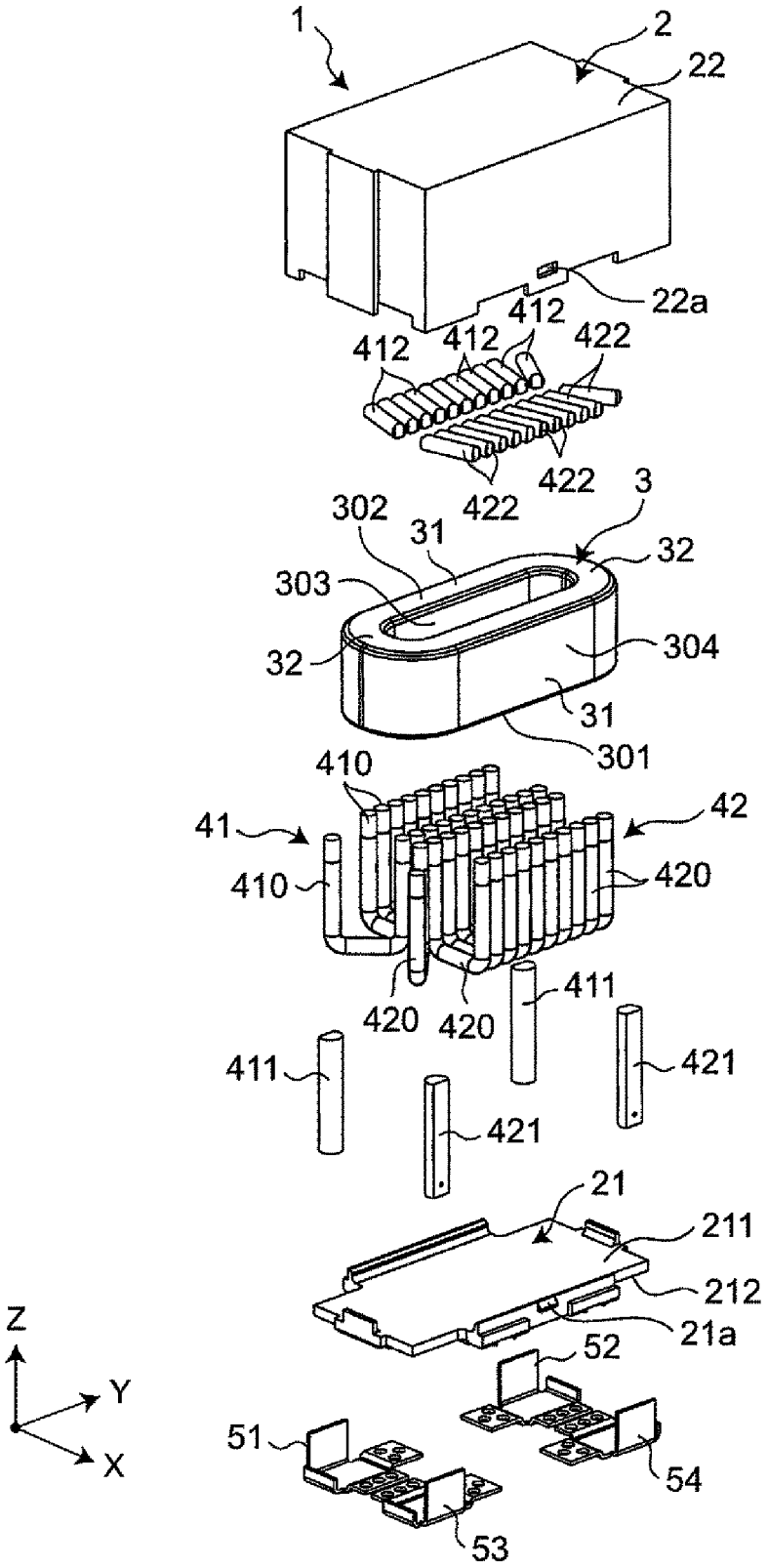
FIG. 4 is an exploded perspective view of the inductor component according to the embodiment of the present disclosure.

FIG. 1 is an upper perspective view of an inductor component according to an embodiment of the present disclosure. FIG. 2 is a lower perspective view of the inductor component. FIG. 3 is an upper perspective view illustrating the inside of the inductor component. FIG. 4 is an exploded perspective view of the inductor component.

As illustrated in FIGS. 1 to 4, an inductor component 1 includes a case 2, an annular core 3 that is accommodated in the case 2, a first coil 41 and a second coil 42 that are wound around the core 3 so as to face each other, and first to fourth electrode terminals 51 to 54 that are attached to the case 2 and connected to the first coil 41 and the second coil 42. The inductor component 1 is, for example, a common-mode choke coil or the like.

The case 2 includes a bottom plate portion 21 and a box portion 22 that covers the bottom plate portion 21. The case 2 is made of a material that has strength, heat resistance, and is preferably made of a fire-retardant material. For example, the case 2 is made of: a resin such as polyphenylene sulfide (PPS), liquid crystal polymer (LCP), or polyphthalamide (PPA); or ceramics. The bottom plate portion 21 includes a first main surface 211 and a second main surface 212 that face each other. The first main surface 211 is an upper surface adjacent to the box portion 22, and the second main surface 212 is a bottom surface. The shape of the bottom plate portion 21 is a rectangle when seen in a direction perpendicular to the first main surface 211. Here, the transversal direction of the case 2 (the bottom plate portion and the box portion 22) is defined as the X-direction, the longitudinal direction of the case 2 is defined as the Y-direction, and the height direction of the case 2 is defined as the Z-direction. The X-direction, the Y-direction, and the Z-direction are perpendicular to each other. When the shape of the case 2 is a square, the length of the case 2 in the X-direction and the length of the case 2 in the Y-direction are the same.

The bottom plate portion 21 has an engagement projection 21*a*, and the box portion 22 has an engagement hole 22*a*. As the engagement projection 21*a* is inserted into the engagement hole 22*a*, the box portion 22 is attached to the bottom plate portion 21. As the engagement projection 21*a* is released from the engagement hole 22*a*, the box portion 22 is removed from the bottom plate portion 21.

The first to fourth electrode terminals 51 to 54 are attached to the bottom plate portion 21. The first electrode terminal 51 and the second electrode terminal 52 are positioned at two corners of the bottom plate portion 21 that face each other in the Y-direction, and the third electrode terminal 53 and the fourth electrode terminal 54 are positioned at two corners of the bottom plate portion 21 that face each other in the Y-direction. The first electrode terminal 51 and the third electrode terminal 53 face each other in the X-direction, and the second electrode terminal 52 and the fourth electrode terminal 54 face each other in the X-direction.

The shape of the core 3 is an oval (track shape) when seen in the axial direction. When seen in the axial direction, the core 3 includes a pair of longitudinal portions 31 that extend along the major axis and face each other in the minor-axis direction, and a pair of transversal portions 32 that extend along the minor axis and that face each other in the major-axis direction. The shape of the core 3 may be a rectangle or an ellipse when seen in the axial direction.

The core 3 is, for example, a ceramic core made of ferrite or the like, or a magnetic core made from an iron-based powder compact or a nanocrystal foil. The core 3 has a lower end surface 301 and an upper end surface 302 that face each other in the axial direction, an inner peripheral surface 303, and an outer peripheral surface 304. The lower end surface 301 faces an inner surface of the bottom plate portion 21. The upper end surface 302 faces an inner surface of the box portion 22. The core 3 is accommodated in the case 2 so that the longitudinal direction of the core 3 coincides with the Y-direction.

The shape of a cross-section of the core 3 in a direction perpendicular to the circumferential direction is a rectangle. The lower end surface 301 and the upper end surface 302 are disposed perpendicular to the axial direction of the core 3. The inner peripheral surface 303 and the outer peripheral surface 304 are disposed parallel to the axial direction of the core 3. In the present specification, the term "perpendicular" refers not only to a state of being completely perpendicular but also to a state of being substantially perpendicular. The term "parallel" refers not only to a state of being completely parallel but also to a state of being substantially parallel.

The first coil 41 is wound around the core 3 between the first electrode terminal 51 and the second electrode terminal 52. One end of the first coil 41 is connected to the first electrode terminal 51. The other end of the first coil 41 is connected to the second electrode terminal 52.

The second coil 42 is wound around the core 3 between the third electrode terminal 53 and the fourth electrode terminal 54. One end of the second coil 42 is connected to the third electrode terminal 53. The other end of the second coil 42 is connected to the fourth electrode terminal 54.

The first coil 41 and the second coil 42 are wound along the major-axis direction so as to face each other in the minor-axis direction of the core 3. That is, the first coil 41 is wound around one of the longitudinal portions 31 of the core 3, and the second coil 42 is wound around the other longitudinal portion 31 of the core 3. The winding axis of the first coil 41 and the winding axis of the second coil 42 are parallel to each other. The first coil 41 and the second coil 42 are symmetric about the major axis of the core 3.

The number of turns of the first coil 41 and the number of turns of the second coil 42 are the same. The direction in which the first coil 41 is wound around the core 3 is opposite to the direction in which the second coil 42 is wound around the core 3. That is, the direction in which the first coil 41 is wound from the first electrode terminal 51 toward the second electrode terminal 52 is opposite to the direction in which the second coil 42 is wound from the third electrode terminal 53 toward the fourth electrode terminal 54.

The first to fourth electrode terminals 51 to 54 are connected so that common-mode currents flow in the first coil 41 from the first electrode terminal 51 toward the second electrode terminal 52 and flow in the second coil 42 from the third electrode terminal 53 toward the fourth electrode terminal 54, that is, the common-mode currents flow in the same direction. When a common-mode current flows in the first coil 41, a first magnetic flux due to the first coil 41 is generated in the core 3. When a common-mode current flows in the second coil 42, a second magnetic flux is generated in the core 3 in a direction such that the first magnetic flux and the second magnetic flux reinforce each other in the core 3. Therefore, a pair of the first coil 41 and the core 3 and a pair of the second coil 42 and the core 3 each serve as an inductance component, and noise is removed from the common-mode currents.

A plurality of pin members are connected to the first coil 41 by, for example, laser welding, spot welding, solder joint, or the like. The pin members are not a printed circuit board or conductive wires but are bar-shaped members. The pin members each have rigidity and are more resistant to bending than conductive wires that are used for connection between electronic component modules. To be specific, each pin member is resistant to bending for the following reasons: the length of the pin member is shorter than the length of a circumference of each of the lower end surface 301, the upper end surface 302, the inner peripheral surface 303, and the outer peripheral surface 304 of the core 3; and the rigidity of the pin member is high.

Figure 13:
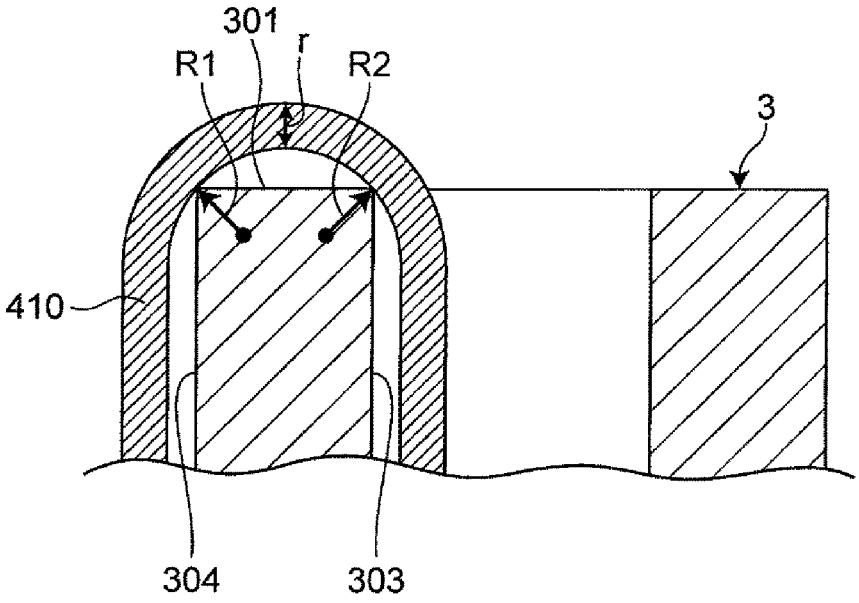
FIG. 13 illustrates a state in which a bent pin member of a coil is wound around a core.

The pin members include: bent pin members 410, each of which is bent in a substantially U-shape; and first and second linear pin members 411 and 412, each of which extends in a substantially linear shape. The first coil 41 includes, in order from one end to the other end, a first linear pin member 411, a plurality of sets of bent pin members 410 and second linear pin members 412, and a first linear pin member 411. The length of the first linear pin member 411 and the length of the second linear pin member 412 are different. The spring index of the bent pin member 410 is as follows: when the bent pin member 410 is wound around the lower end surface 301, the inner peripheral surface 303, and the outer peripheral surface 304 of the core 3 as illustrated in FIG. 13, at the radius of curvature R1 of the bent pin member 410 positioned at a corner of the outer peripheral surface 304 of the core 3 and at the radius of curvature R2 of the bent pin member 410 positioned at a corner of the inner peripheral surface 303 of the core 3, the spring index Ks of the bent pin member 410 is smaller than 3.6. Thus, the bent pin member 410 has high rigidity and is resistant to bending.

The pin members 410 to 412 each include a conductor portion and a coating that covers the conductor portion. The conductor portion is, for example, a copper wire, and the coating is, for example, polyamide-imide resin. The thickness of the coating is, for example, 0.02 to 0.04 mm.

The bent pin members 410 and the second linear pin members 412 are alternately connected to each other by, for example, laser welding, spot welding, solder joint, or the like. One end of a second linear pin member 412 is connected to one end of a bent pin member 410, and the other end of the second linear pin members 412 is connected to one end of another bent pin member 410. By repeating this, the bent pin members 410 and the second linear pin members 412 are connected, and the bent pin members 410 and the second linear pin members 412, which have been connected, are helically wound around the core 3. That is, a set of a bent pin member 410 and a second linear pin member 412 is a unit element for one turn.

The bent pin members 410 are parallelly arranged along each of the lower end surface 301, the inner peripheral surface 303, and the outer peripheral surface 304 of the core 3. The second linear pin members 412 are parallelly arranged along the upper end surface 302 of the core 3. The first linear pin members 411 are parallelly arranged along the outer peripheral surface 304 of the core 3.

The first electrode terminal 51 is connected to one of the first linear pin members 411, and the first linear pin member 411 is connected to one end of a bent pin member 410 that is adjacent to the first linear pin member 411. The second electrode terminal 52 is connected to the other first linear pin member 411, and the first linear pin member 411 is connected to one end of a second linear pin member 412 that is adjacent to the first linear pin member 411.

The second coil 42 is composed of a plurality of pin members, as with the first coil 41. That is, the second coil 42 includes, in order from one end to the other end, a first linear pin member 421, a plurality of sets of bent pin members 420 and second linear pin members 422, and a first linear pin member 421. The bent pin members 420 and the second linear pin members 422 are alternately connected to each other and wound around the core 3. That is, the bent pin members 420 and the second linear pin members 422 are connected, and the bent pin members 420 and second linear pin members 422, which are connected, are helically wound around the core 3.

The third electrode terminal 53 is connected to one of the first linear pin members 421, and the first linear pin member 421 is connected to one end of a bent pin member 420 that is adjacent to the first linear pin member 421. The fourth electrode terminal 54 is connected to the other first linear pin member 421, and the first linear pin member 421 is connected to one end of a second linear pin member 422 that is adjacent to the first linear pin member 421.

Figure 5:
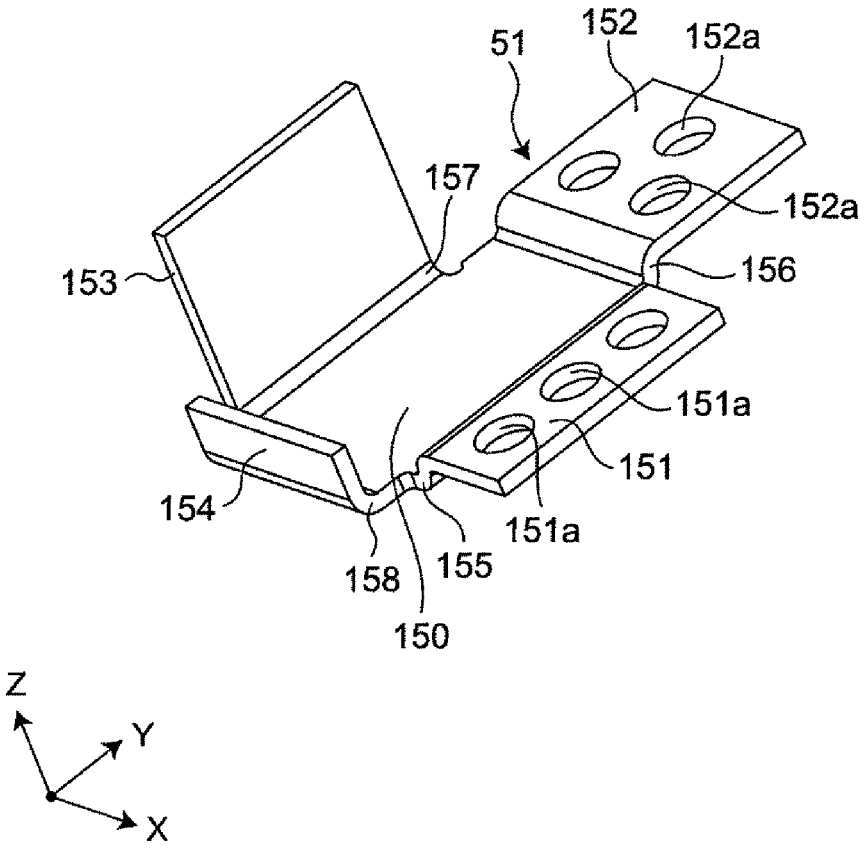
FIG. 5 is a perspective view of a first electrode terminal.

FIG. 5 is a perspective view of the first electrode terminal 51. Hereafter, the first electrode terminal 51 will be described. Descriptions of the second to fourth electrode terminals 52 to 54, which are similar to that of the first electrode terminal 51, will be omitted.

The first electrode terminal 51 includes a mounting surface portion 150, a first mold surface portion 151, a second mold surface portion 152, a connection surface portion 153, and a fillet surface portion 154. The first electrode terminal 51 is formed, for example, by punching and bending a metal plate.

The mounting surface portion 150 has a rectangular flat-plate shape along the XY-plane. The mounting surface portion 150 is formed so that the long sides thereof are parallel to the Y-direction and the short sides thereof are parallel to the X-direction.

The first and second mold surface portions 151 and 152 are connected to adjacent sides of the mounting surface portion 150 with boundary portions 155 and 156 therebetween. The first mold surface portion 151 is connected to a long side of the mounting surface portion 150 with the boundary portion 155 therebetween, and the second mold surface portion 152 is connected to a short side of the mounting surface portion 150 with the boundary portion 156 therebetween. The first and second mold surface portions 151 and 152 are disposed at positions higher than the mounting surface portion 150 in the Z-direction so as to be parallel to the mounting surface portion 150. The first and second mold surface portions 151 and 152 respectively have a plurality of holes 151*a* and a plurality of holes 152*a*. The first and second mold surface portions 151 and 152 each have a rectangular flat-plate shape along the XY-plane, and the boundary portions 155 and 156 each have a curved shape.

The connection surface portion 153 is connected to a long side of the mounting surface portion 150 with a boundary portion 157 therebetween. The connection surface portion 153 stands perpendicular to the mounting surface portion 150 in the Z-direction. The connection surface portion 153 has a rectangular flat-plate shape along the YZ-plane, and the boundary portion 157 has a curved shape. The connection surface portion 153 is perpendicular to the mounting surface portion 150.

The fillet surface portion 154 is connected to a short side of the mounting surface portion 150 with a boundary portion 158 therebetween. The fillet surface portion 154 stands perpendicular to the mounting surface portion 150 in the Z-direction. The fillet surface portion 154 has a rectangular flat-plate shape along the YZ-plane, and the boundary portion 158 has a curved shape. The fillet surface portion 154 is perpendicular also to the connection surface portion 153.

Figure 6:
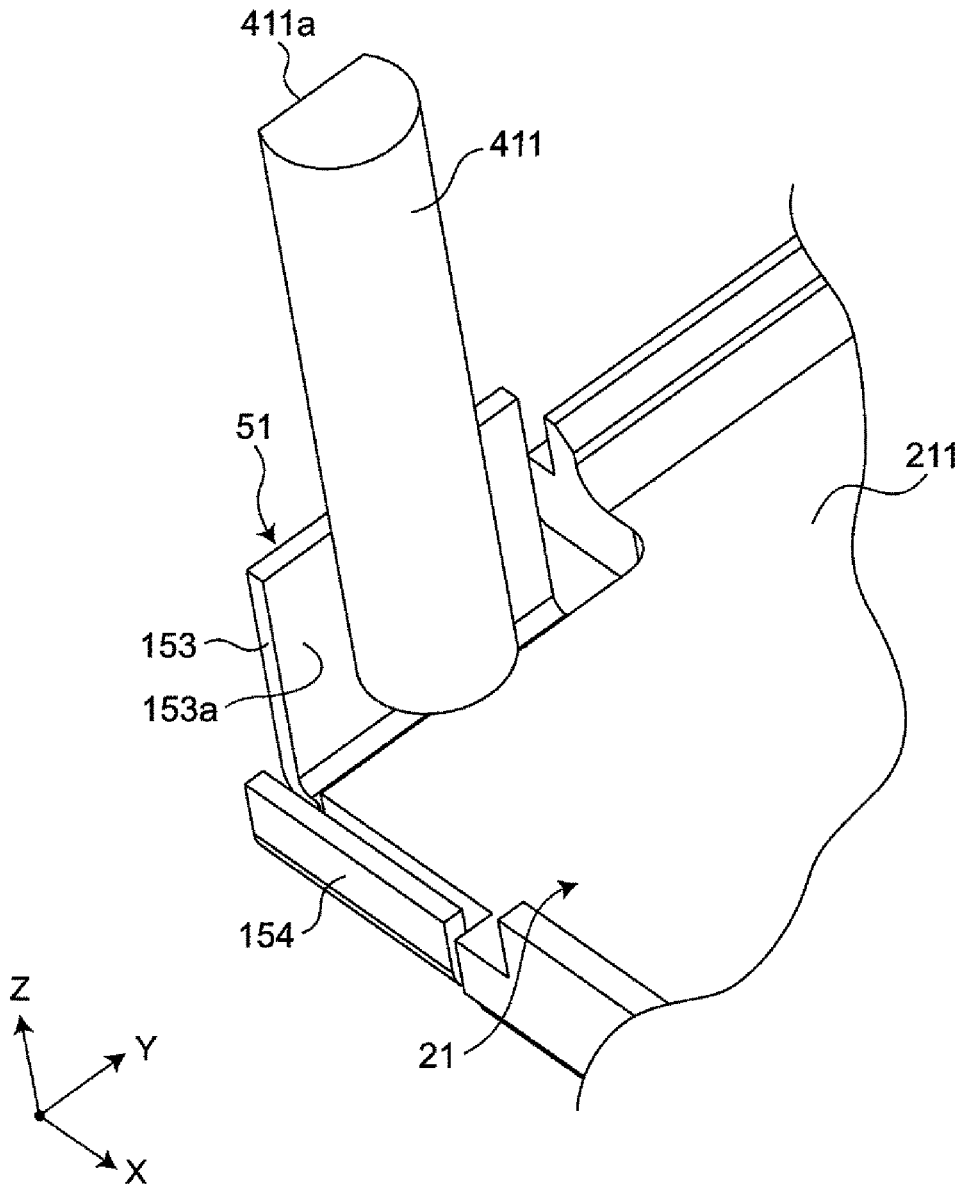
FIG. 6 is a perspective view illustrating a state in which the first electrode terminal is attached to a bottom plate portion.

FIG. 6 is a perspective view illustrating a state in which the first electrode terminal 51 is attached to the bottom plate portion 21. Descriptions of the second, third, and fourth electrode terminals 52, 53, and 54, which are similar to that of the first electrode terminal 51, will be omitted.

As illustrated in FIG. 6, the first electrode terminal 51 is attached to the bottom plate portion 21 of the case 2, and the first linear pin member 411 of the first coil 41 is attached to the first electrode terminal 51.

The connection surface portion 153 of the first electrode terminal 51 is exposed from the periphery of the bottom plate portion 21. The connection surface portion 153 is a portion that is connected to the first coil 41. That is, the first linear pin member 411 is connected to the connection surface portion 153. The first linear pin member 411 is connected so as to extend in the Z-direction. The first linear pin member 411 is disposed on the inner side of the connection surface portion 153 (the inner side of the case).

To be specific, the outer peripheral surface of the first linear pin member 411 (a part of the coil 41) includes a connection surface 411*a*. The connection surface 411*a* is a flat surface that extends along the axis of the first linear pin member 411. The connection surface 411*a* of the first linear pin member 411 is in surface-contact with a first main surface 153*a* on the inner side of the connection surface portion 153 in a state in which the connection surface 411*a* is positioned parallel to the first main surface 153*a*. That is, the connection surface 411*a* and the first main surface 153*a* are connected in a state in which these surfaces are in surface-contact with each other. The first main surface 153*a* and the outer peripheral surface 304 of the core 3 are parallel to each other. Thus, the first coil 41 is connected to the first electrode terminal 51. The connection surface 411*a* and the first main surface 153*a* are parallel to each other, and thus surface-contact of the connection surface 411*a* and the first main surface 153*a* is realized, and it is not necessary to wrap the first coil 41 around first electrode terminal 51. The first main surface 153*a* and the outer peripheral surface 304 of the core 3 are parallel to each other. Although the connection surface 411*a* is a flat surface, the connection surface 411*a* may have any shape, such as a curved shape, as long as the connection surface 411*a* can be in surface-contact with the first main surface 153*a* along the first main surface 153*a*, and the connection surface 411*a* and the first main surface 153*a* may be parallel to each other.

The fillet surface portion 154 of the first electrode terminal 51 is exposed from the periphery of the bottom plate portion 21. The fillet surface portion 154 is a portion along which solder is to creep up. Accordingly, when mounting the inductor component 1 onto a mount substrate by using solder, the solder creeps up along the fillet surface portion 154, and it is possible to visually inspect the solder joint after being mounted and to increase the strength of solder connection. Preferably, the fillet surface portion 154 is plated with tin so as to have sufficient solder wettability.

Figure 7:
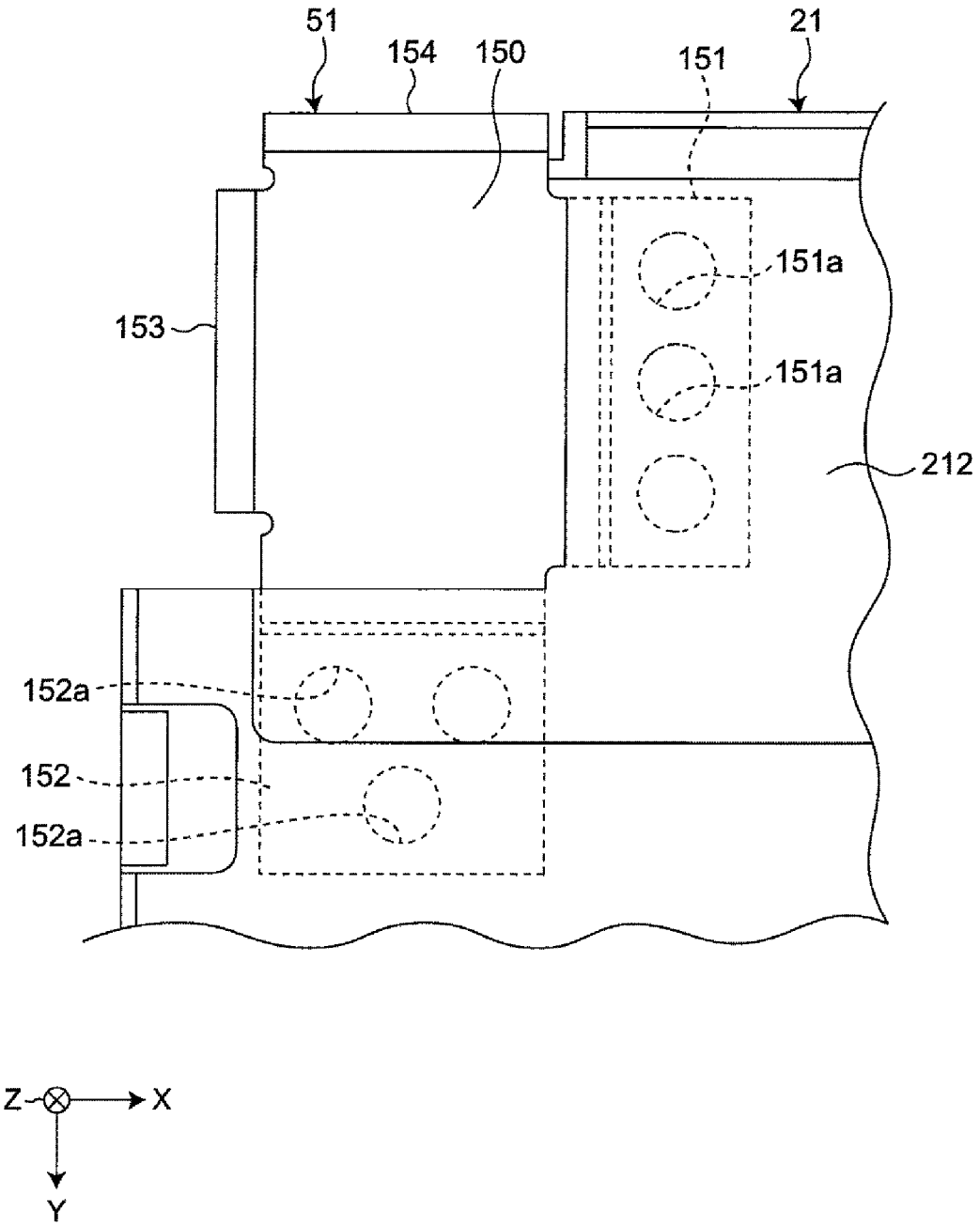
FIG. 7 is a bottom view illustrating the state in which the first electrode terminal is attached to the bottom plate portion.

FIG. 7 is a bottom view illustrating a state in which the first electrode terminal 51 is attached to the bottom plate portion 21. Descriptions of the second, third, and fourth electrode terminals 52, 53, and 54, which are similar to that of the first electrode terminal 51, will be omitted.

As illustrated in FIG. 7, the first electrode terminal 51 is attached to the bottom plate portion 21 of the case 2. The mounting surface portion 150 of the first electrode terminal 51 is exposed on the second main surface 212 (bottom surface) side of the bottom plate portion 21 and is a portion to be connected to a mount substrate. The mounting surface portion 150 is connected to the mount substrate by, for example, reflow soldering. Preferably, the mounting surface portion 150 is plated with tin so as to have sufficient solder wettability.

The first and second mold surface portions 151 and 152 of the first electrode terminal 51 are portions to be integrated with the bottom plate portion 21 of the case 2. For example, the first and second mold surface portions 151 and 152 are embedded in the bottom plate portion 21 by being integrally molded. At this time, the material of the bottom plate portion 21 enters also into the holes 151*a* and 152*a*, and the first electrode terminal 51 is firmly fixed to the bottom plate portion 21. Accordingly, the first electrode terminal 51 is integrated with the bottom plate portion 21 of the case 2, and thus the inductor component 1 is resistant to vibration and impact load.

Figure 8:
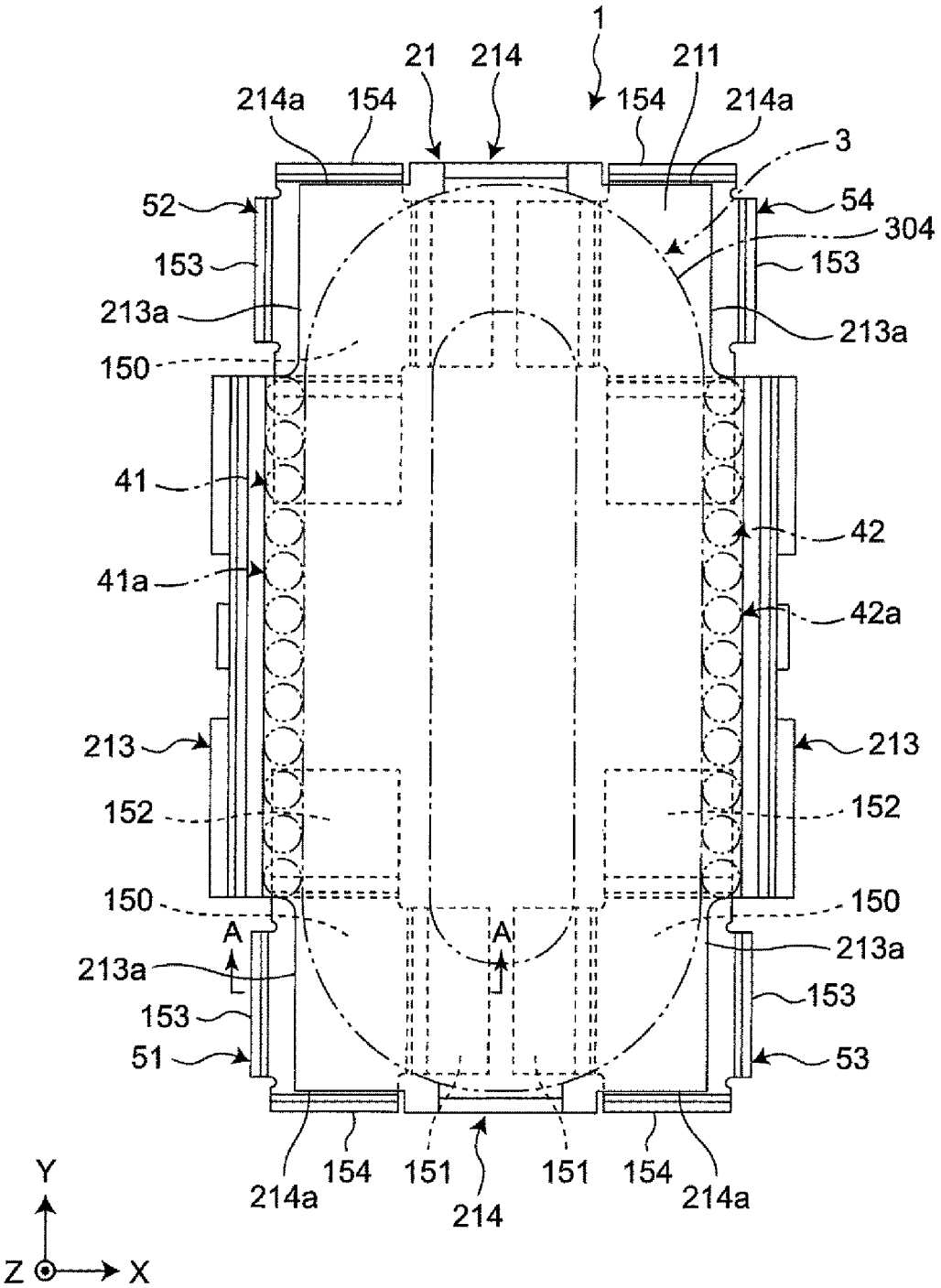
FIG. 8 is a plan view illustrating a state in which first to fourth electrode terminals are attached to the bottom plate portion.

FIG. 8 is a plan view illustrating a state in which the first to fourth electrode terminals 51 to 54 are attached to the bottom plate portion 21. In FIG. 8, a part of the first and second coils 41 and 42 and the core 3 are shown by two-dot chain lines. As illustrated in FIG. 8, at least a part of the mounting surface portion 150 of each of the first to fourth electrode terminals 51 to 54 overlaps the core 3 when seen in a see-through view in a direction perpendicular to the first main surface 211 of the bottom plate portion 21 (the Z-direction). Thus, each of the first to fourth electrode terminals 51 to 54 is not disposed separated from the core 3 in a direction along the first main surface 211 of the bottom plate portion 21, and therefore the size of the bottom plate portion 21 in directions along the first main surface 211 (the X-direction and the Y-direction) can be reduced. Accordingly, the inductor component 1 can be reduced in size. Preferably, when seen in the Z-direction, the center of the mounting surface portion 150 is positioned further inward than the outer periphery of the core 3. In this case, the inductor component 1 can be further reduced in size.

The connection surface portion 153 and the fillet surface portion 154 are each disposed further outward, in a direction along the first main surface 211 of the bottom plate portion 21, than the mounting surface portion 150 that is exposed on the second main surface 212 side. The exposed mounting surface portion 150 is parallel to the second main surface 212 of the bottom plate portion 21. Thus, the connection surface portion 153 and the fillet surface portion 154 need not be disposed on the bottom surface of the inductor component 1, and the inductor component 1 can be further reduced in size.

The bottom plate portion 21 is rectangular when seen in the Z-direction, and the first to fourth electrode terminals 51 to 54 are disposed at the corners of the rectangular bottom plate portion 21. Thus, the first to fourth electrode terminals 51 to 54 each can be disposed in a vacant space on the bottom plate portion 21 that is generated when the core 3 and coils 41 and 42 are placed on the bottom plate portion 21, and the inductor component 1 can be further reduced in size.

When seen in the Z-direction, the bottom plate portion 21 includes two first side surfaces 213 that extend in the Y-direction (first direction) and that face in the X-direction (second direction), and two second side surfaces 214 that extend in the X-direction and that face in the Y-direction. The connection surface portion 153 is disposed on a corresponding one of the first side surfaces 213 of the bottom plate portion 21, and the fillet surface portion 154 is disposed on a corresponding one of the second side surfaces 214 of the bottom plate portion 21. Thus, the connection surface portion 153 and the fillet surface portion 154 need not be disposed on the bottom surface of the inductor component 1 when seen in the Z-direction, and the inductor component 1 can be further reduced in size.

The first side surface 213 has a first recessed groove 213*a* at each corner of the bottom plate portion 21. The second side surface 214 has a second recessed groove 214*a* at each corner of the bottom plate portion 21. Each of the first recessed groove 213*a* and the second recessed groove 214*a* is a groove formed at an outer periphery of the bottom plate portion 21 when seen in the Z-direction, and is rectangular when seen in the Z-direction. The connection surface portion 153 is inserted into the first recessed groove 213*a*, and the fillet surface portion 154 is inserted into the second recessed groove 214*a*. Thus, the connection surface portion 153 and the fillet surface portion 154 can be disposed further inward than the outer periphery of the bottom plate portion 21, and the inductor component 1 can be further reduced in size. The first recessed groove 213*a* and the second recessed groove 214*a* are connected, so that the recessed grooves can be easily manufactured. Alternatively, the first recessed groove 213*a* and the second recessed groove 214*a* may be separated from each other.

The connection surface portion 153 is perpendicular to the mounting surface portion 150. Thus, a sufficient distance can be maintained in each of the electrode terminals 51 to 54 via the mounting surface portion 150, and therefore influence of heat generated in the connection surface portion 153 is not easily transferred to the mounting surface portion 150. Moreover, because the connection surface portion 153 is perpendicular to the mounting surface portion 150, the space occupied by the electrode terminal can be reduced in a direction parallel to the first main surface 211 of the bottom plate portion 21.

The outer peripheral surface 304 of the core 3 extends in the Z-direction, and the first linear pin member 411 of the first coil 41 is directed in the Z-direction. The connection surface portion 153 of the first electrode terminal 51 and the connection surface portion 153 of the second electrode terminal 52 are parallel to an outer peripheral surface 41*a* of the first coil 41 when seen in the Z-direction. Thus, the connection surface portion 153 does not protrude from the outer peripheral surface 41*a* of the first coil 41, and therefore the inductor component 1 can be further reduced in size. Moreover, the connection surface portion 153 can be disposed parallel to the outer peripheral surface 41*a* of the first coil 41, and therefore the length of an electrical path to the first coil 41 can be reduced, and direct-current resistance can be reduced. Likewise, the first linear pin member 421 of the second coil 42 is directed in the Z-direction. The connection surface portion 153 of the third electrode terminal 53 and the connection surface portion 153 of the fourth electrode terminal 54 are parallel to an outer peripheral surface 42*a* of the second coil 42 when seen in the Z-direction.

Figure 9:
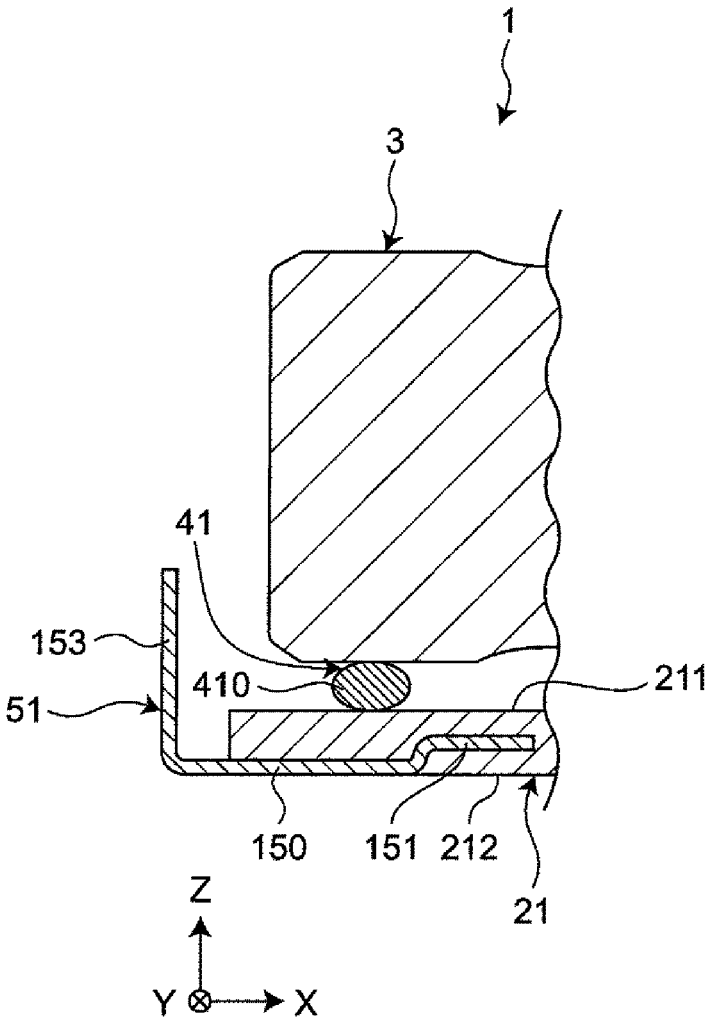
FIG. 9 is an XZ-sectional view of the inductor component according to the embodiment.

FIG. 9 is an XZ-sectional view of the inductor component 1, taken along line A-A in FIG. 8. As illustrated in FIG. 9, the bottom plate portion 21 exists between the mounting surface portion 150 of the first electrode terminal 51 and the core 3 in the Z-direction. Thus, the first coil 41, which is wound around the core 3, can be prevented from making contact with the mounting surface portion 150 and becoming electrically connected to the mounting surface portion 150. That is, the bent pin member 410 of the first coil 41, which is positioned between the core 3 and the mounting surface portion 150, does not make contact with the mounting surface portion 150 due to the existence of the bottom plate portion 21. Descriptions of second, third, and fourth electrode terminals 52, 53, and 54, which are similar to that of the first electrode terminal 51, will be omitted.

Figure 10:
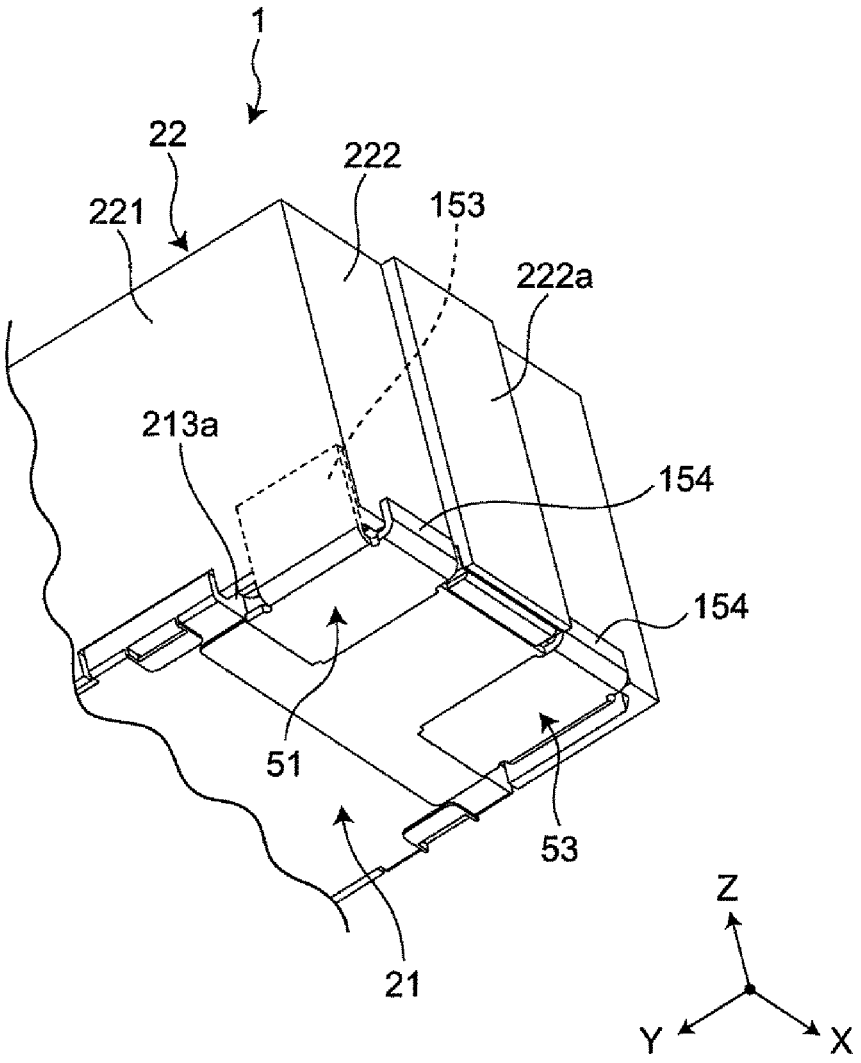
FIG. 10 is a lower perspective view of the inductor component according to the embodiment of the present disclosure.

FIG. 10 is a lower perspective view of the inductor component 1. As illustrated in FIG. 10, the connection surface portion 153 of the first electrode terminal 51 is inserted into the box portion 22. That is, the connection surface portion 153 is inserted into a slit formed by the first recessed groove 213*a* of the bottom plate portion 21 and the box portion 22. Thus, the connection surface portion 153 is accommodated together with the coil in the box portion 22, the connection surface portion 153 is not easily interfered with from the outside, and the reliability of connection between the connection surface portion 153 and the coil can be increased. For example, solder (flux) does not easily adhere to the connection surface portion 153, and another member does not easily make contact with the connection surface portion 153. Descriptions of second, third, and fourth electrode terminals 52, 53, and 54, which are similar to that of the first electrode terminal 51, will be omitted.

The fillet surface portion 154 is exposed to the outside of the box portion 22, and a protruding portion 222*a* is formed on an outer surface of the box portion 22 on which the fillet surface portion 154 is positioned. The protruding portion 222*a* is positioned further outward than the fillet surface portion 154 in a direction perpendicular to the outer surface. To be specific, the box portion 22 includes two first side walls 221 that extend in the Y-direction and that face in the X-direction, and two second side walls 222 that extend in the X-direction and that face in the Y-direction. The protruding portion 222*a* is formed on each of the second side walls 222. The protruding portion 222*a* extends in the Z-direction at a middle part of the second side wall 222 in the X-direction. The fillet surface portion 154 of the first electrode terminal 51 faces the second side wall 222 on which the protruding portion 222*a* is formed, and, preferably is in contact with the second side wall 222. The protruding portion 222*a* is positioned further outward than the fillet surface portion 154 in the Y-direction. That is, the fillet surface portion 154 does not protrude further than the protruding portion 222*a* in the Y-direction. Thus, when mounting the inductor component 1, another member can be prevented from abutting against the protruding portion 222*a* and coming into contact with the fillet surface portion 154. Descriptions of second, third, and fourth electrode terminals 52, 53, and 54, which are similar to that of the first electrode terminal 51, will be omitted.

Method of Manufacturing Inductor Component

Next, a method of manufacturing the inductor component 1 will be described.

Figure 11:
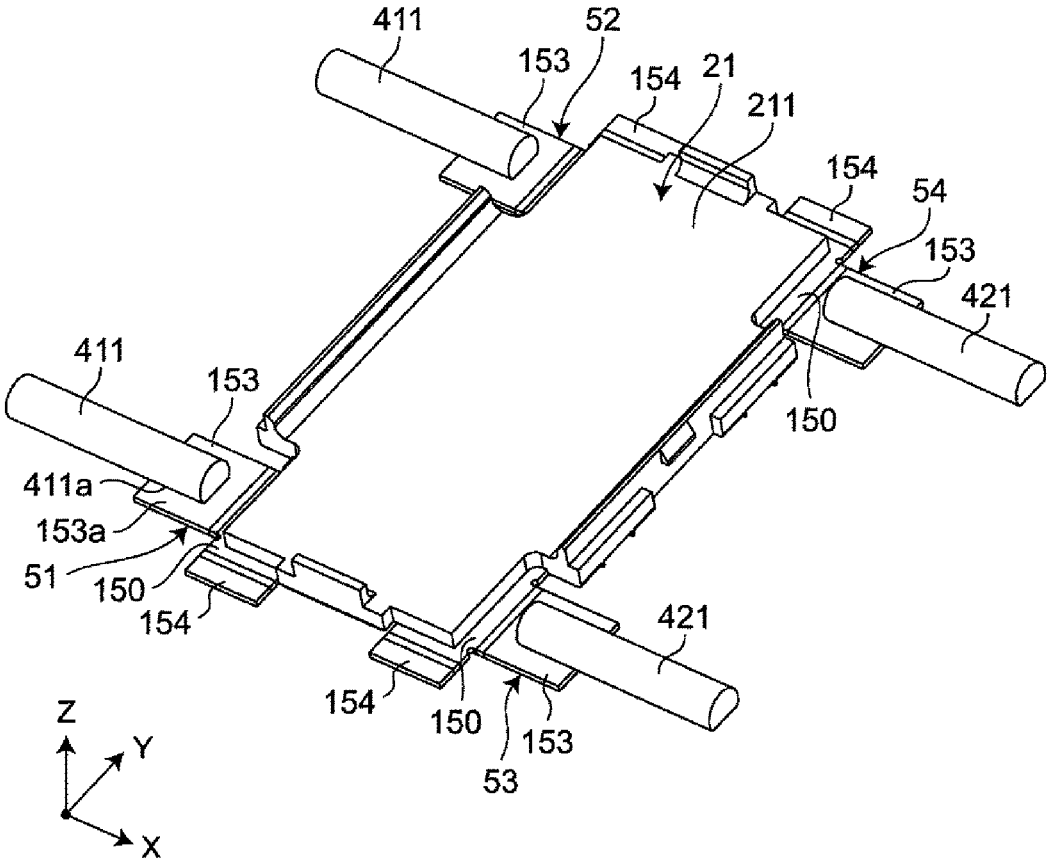
FIG. 11 illustrates a method of manufacturing an inductor component according to an embodiment of the present disclosure.

As illustrated in FIG. 11, the first to fourth electrode terminals 51 to 54 are attached to the bottom plate portion 21 by integral molding. To be specific, the first and second mold surface portions 151 and 152 of the first to fourth electrode terminals 51 to 54 are embedded in the bottom plate portion 21, and thus the first to fourth electrode terminals 51 to 54 are attached to the bottom plate portion 21. At this time, at each of the first to fourth electrode terminals 51 to 54, the mounting surface portion 150, the connection surface portion 153, and the fillet surface portion 154 are in a state of being developed on an identical plane.

Subsequently, at the first electrode terminal 51, in a state in which the mounting surface portion 150, the connection surface portion 153, and the fillet surface portion 154 are developed on an identical plane, the connection surface 411*a* of the first linear pin member 411 is brought into surface-contact with the first main surface 153*a* of the connection surface portion 153 and is welded to the first main surface 153*a* in a state in which the connection surface 411*a* is positioned parallel to the first main surface 153*a*. At this time, welding is performed by emitting a laser beam from the second main surface on the opposite side from the first main surface 153*a* (in the Z-direction). The same applies to welding of the second electrode terminal 52 and the first linear pin member 411, welding of the third electrode terminal 53 and the first linear pin member 421, and welding of the fourth electrode terminal 54 and the first linear pin member 421.

Figure 12:
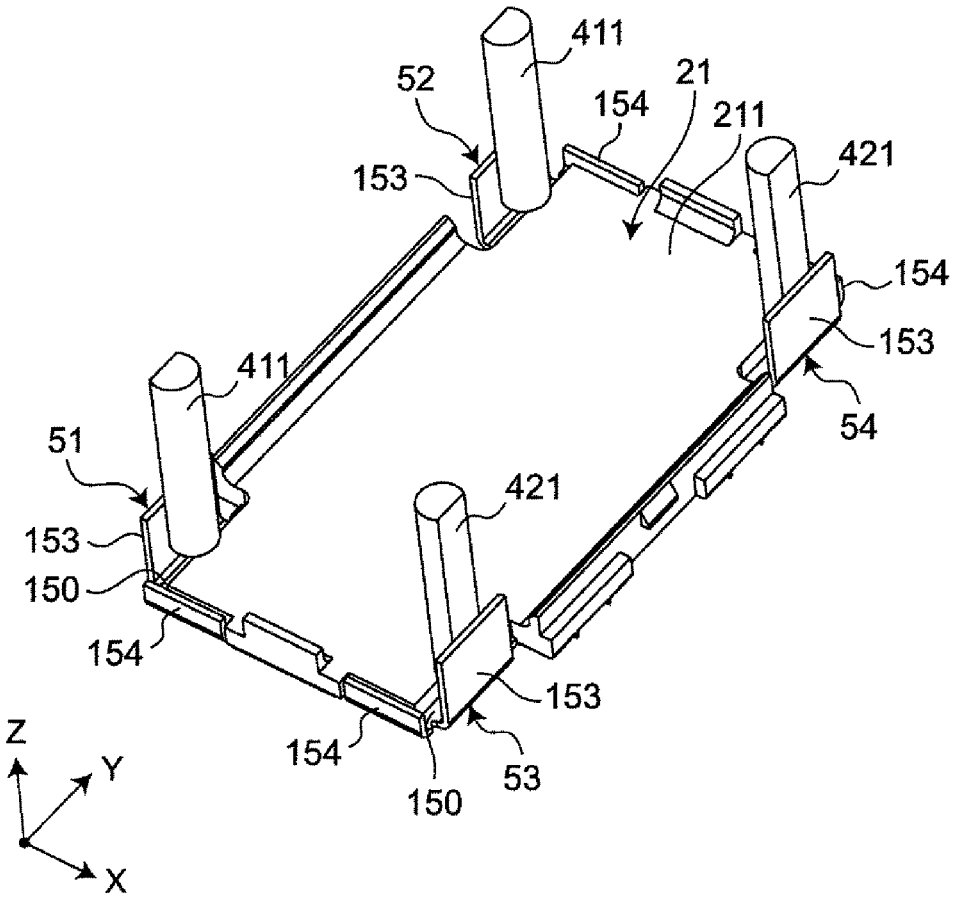
FIG. 12 illustrates the method of manufacturing an inductor component according to the embodiment of the present disclosure.

Subsequently, as illustrated in FIG. 12, at the first electrode terminal 51, the connection surface portion 153 is bent relative to the mounting surface portion 150, and thus connection surface portion 153 is caused to stand perpendicular to the mounting surface portion 150. Moreover, the fillet surface portion 154 is bent relative to the mounting surface portion 150, and the fillet surface portion 154 is caused to stand perpendicular to the mounting surface portion 150. At this time, because the bottom plate portion 21 exists between the mounting surface portion 150 and the core 3 as illustrated in FIG. 9, when bending the connection surface portion 153 and the fillet surface portion 154, the mounting surface portion 150 is supported by the bottom plate portion 21, and deformation of the mounting surface portion 150 can be prevented. The same applies to the second to fourth electrode terminals 52 to 54.

Subsequently, as illustrated in FIG. 4, a step of assembling the core 3 and the coils 41 and 42, and a step of accommodating the core 3 and the coils 41 and 42 into the case 2 are performed, and thus the inductor component 1 is manufactured.

Spring Index of Bent Pin Member of Coil

The spring index of a bent pin member of a coil will be described. FIG. 13 illustrates a state in which the bent pin member 410 is wound around the core 3. Referring to FIG. 13, the spring index Ks=(radius of curvature R1 or R2 of bent pin member)/(wire diameter r of bent pin member). The "radius of curvature R1" is a radius of curvature positioned at a corner of the outer peripheral surface 304 of the core 3, and the "radius of curvature R2" is a radius of curvature positioned at a corner of the inner peripheral surface 303 of the core 3. The spring index Ks of the bent pin member 410 is smaller than 3.6 at either of the radii of curvatures R1 and R2. In contrast, it is known by experiment that, with an ordinary winding method, the spring index is larger than or equal to 3.6.

The present disclosure is not limited to the embodiment described above, and may be modified within the spirit and scope of the present disclosure. For example, the shape of the case and the shape of the electrode terminal are not limited to those in the present embodiment, and may be modified. The number of coils and the number of electrode terminals are not limited to those in the embodiment described above, and may be changed. The coil is composed of a plurality of pin members in the embodiment, by the coil may be formed from a conductive wire. At least one of the four electrode terminals may overlap the core when seen in a direction perpendicular to the first main surface of the bottom plate portion.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a bottom plate portion that includes a first main surface and a second main surface that face each other;

an annular core that is disposed on the bottom plate portion;

a coil that is wound around the core; and an electrode terminal that is attached to the bottom plate portion and electrically connected to the coil, wherein the electrode terminal includes a mounting surface portion that is configured to connect to a mount substrate, the core is disposed on the first main surface of the bottom plate portion so that an axis of the core intersects the first main surface of the bottom plate portion, the mounting surface portion is exposed on the second main surface side of the bottom plate portion, and at least a part of the mounting surface portion overlaps the core when seen in a direction perpendicular to the first main surface of the bottom plate portion, and the bottom plate portion includes first side surfaces and second side surfaces, with a connection surface portion of the electrode terminal being disposed on a corresponding one of the first side surfaces of the bottom plate portion, and a fillet surface portion being disposed on a corresponding one of the second side surfaces of the bottom plate portion.

2. The inductor component according to claim 1, wherein the connection surface portion is connected to the mounting surface portion and connected to the coil, and the fillet surface portion is connected to the mounting surface portion and along which solder is to creep up, and the connection surface portion and the fillet surface portion are each disposed further outward, in a direction along the first main surface of the bottom plate portion, than the mounting surface portion that is exposed on the second main surface side.

3. The inductor component according to claim 2, wherein the bottom plate portion is substantially rectangular when seen in the direction perpendicular to the first main surface of the bottom plate portion, and the electrode terminal is disposed at a corner of the substantially rectangular bottom plate portion.

4. The inductor component according to claim 3, wherein the first side surfaces extend in a first direction and face in a second direction perpendicular to the first direction when seen in the direction perpendicular to the first main surface of the bottom plate portion, and the second side surfaces extend in the second direction and face in the first direction.

5. The inductor component according to claim 4, wherein the first side surfaces each have a first recessed groove at a corner of the bottom plate portion, and the second side surfaces each have a second recessed groove at a corner of the bottom plate portion, and the connection surface portion is inserted into the first recessed groove, and the fillet surface portion is inserted into the second recessed groove.

6. The inductor component according to claim 2, wherein the connection surface portion is perpendicular to the mounting surface portion.

7. The inductor component according to claim 2, wherein an outer peripheral surface of the core extends in the direction perpendicular to the first main surface of the bottom plate portion, and a pin member of the coil is directed in the direction perpendicular to the first main surface of the bottom plate portion, and the connection surface portion is parallel to the outer peripheral surface of the coil when seen in the direction perpendicular to the first main surface of the bottom plate portion.

8. The inductor component according to claim 2, wherein the bottom plate portion exists between the mounting surface portion and the core in the direction perpendicular to the first main surface of the bottom plate portion.

9. The inductor component according to claim 2, further comprising:

a box portion that covers the coil, wherein the connection surface portion is inserted into the box portion.

10. The inductor component according to claim 9, wherein the fillet surface portion is exposed to an outside of the box portion, a protruding portion is formed on an outer surface of the box portion on which the fillet surface portion is positioned, and the protruding portion is positioned further outward than the fillet surface portion in a direction perpendicular to the outer surface.

11. The inductor component according to claim 3, wherein the connection surface portion is perpendicular to the mounting surface portion.

12. The inductor component according to claim 4, wherein the connection surface portion is perpendicular to the mounting surface portion.

13. The inductor component according to claim 5, wherein the connection surface portion is perpendicular to the mounting surface portion.

14. The inductor component according to claim 3, wherein an outer peripheral surface of the core extends in the direction perpendicular to the first main surface of the bottom plate portion, and a pin member of the coil is directed in the direction perpendicular to the first main surface of the bottom plate portion, and the connection surface portion is parallel to the outer peripheral surface of the coil when seen in the direction perpendicular to the first main surface of the bottom plate portion.

15. The inductor component according to claim 4, wherein an outer peripheral surface of the core extends in the direction perpendicular to the first main surface of the bottom plate portion, and a pin member of the coil is directed in the direction perpendicular to the first main surface of the bottom plate portion, and the connection surface portion is parallel to the outer peripheral surface of the coil when seen in the direction perpendicular to the first main surface of the bottom plate portion.

16. The inductor component according to claim 5, wherein an outer peripheral surface of the core extends in the direction perpendicular to the first main surface of the bottom plate portion, and a pin member of the coil is directed in the direction perpendicular to the first main surface of the bottom plate portion, and the connection surface portion is parallel to the outer peripheral surface of the coil when seen in the direction perpendicular to the first main surface of the bottom plate portion.

17. The inductor component according to claim 3, wherein the bottom plate portion exists between the mounting surface portion and the core in the direction perpendicular to the first main surface of the bottom plate portion.

18. The inductor component according to claim 4, wherein the bottom plate portion exists between the mounting surface portion and the core in the direction perpendicular to the first main surface of the bottom plate portion.

19. The inductor component according to claim 3, further comprising:

a box portion that covers the coil, wherein the connection surface portion is inserted into the box portion.

20. The inductor component according to claim 4, further comprising:

a box portion that covers the coil, wherein the connection surface portion is inserted into the box portion.

* * * * *